US008163137B2

(12) United States Patent
Tanttu et al.

(10) Patent No.: US 8,163,137 B2
(45) Date of Patent: Apr. 24, 2012

(54) APPARATUS FOR CLEANING AND/OR COOLING A LIQUOR GUN IN A CHEMICAL RECOVERY BOILER

(75) Inventors: Markku Tanttu, Lahti (FI); Kari Saviharju, Espoo (FI); Sirpa Du Jardin, Varkaus (FI)

(73) Assignee: Andritz Oy, Helsinki (FI)

( * ) Notice: Subject to any disclaimer, the term of this patent is extended or adjusted under 35 U.S.C. 154(b) by 0 days.

(21) Appl. No.: 13/080,985

(22) Filed: Apr. 6, 2011

(65) Prior Publication Data

US 2011/0240243 A1 Oct. 6, 2011

Related U.S. Application Data

(62) Division of application No. 12/166,612, filed on Jul. 2, 2008, now Pat. No. 7,988,820.

(30) Foreign Application Priority Data

Jul. 13, 2007 (FI) ..... 20070547

(51) Int. Cl.
*D21C 11/12* (2006.01)
*F27D 25/00* (2010.01)
*F27D 3/14* (2006.01)

(52) U.S. Cl. ..... 162/239; 162/240; 432/75; 432/173

(58) Field of Classification Search ..... 162/29, 162/30.1, 30.11, 21, 239, 240; 122/6.5, 7 R; 432/173

See application file for complete search history.

(56) References Cited

U.S. PATENT DOCUMENTS

| | | | |
|---|---|---|---|
| 4,212,628 | A | 7/1980 | Boatwright |
| 5,320,967 | A | 6/1994 | Avallone et al. |
| 5,715,763 | A | 2/1998 | Fornetti et al. |
| 5,874,449 | A | 2/1999 | Hamilton et al. |
| 6,024,028 | A | 2/2000 | Simonen |
| 6,478,235 | B1 | 11/2002 | Soderstrom et al. |
| 6,578,529 | B2 | 6/2003 | Hytonen et al. |
| 2005/0263108 | A1 | 12/2005 | Engvall |
| 2009/0272339 | A1 | 11/2009 | Saviharju et al. |

FOREIGN PATENT DOCUMENTS

| | | |
|---|---|---|
| DE | 199 09 904 A1 | 9/2000 |
| EP | 0 761 871 | 3/1997 |
| FI | 20012500 | 12/2001 |
| FI | 117636 B1 | 6/2003 |
| FI | 120057 | 6/2009 |
| JP | 1-229890 | 9/1989 |
| JP | 2000-256979 | 9/2000 |
| WO | 96/09497 | 3/1996 |
| WO | 00/52259 | 9/2000 |

OTHER PUBLICATIONS

European Search Report completed Dec. 5, 2008. Esa K. Vakkilainen, "Kraft recovery boilers—Principles and practice," Picaset Oy, Helsinki, Finland (2005), pp. 10-1 to 10-9.

Applicant arguments to the EPO for sister foreign application in regards to FI20012500(A), Oct. 13, 2009.

*Primary Examiner* — Matthew Daniels
*Assistant Examiner* — Anthony Calandra
(74) *Attorney, Agent, or Firm* — Nixon & Vanderhye P.C.

(57) ABSTRACT

An apparatus for cleaning and cooling a liquor nozzle, the nozzle including at least a liquor tube for feeding liquor and chemicals into a furnace of a recovery boiler. The apparatus includes an outer casing tube, which defines a space whereto conduits are provided for introducing water and steam to generate an emulsion or a conduit for introducing emulsion generated by the water and steam and the surface of which is provided with openings, such as pores or holes, for discharging the emulsion formed by water and steam through the outer casing.

20 Claims, 3 Drawing Sheets

APPARATUS FOR CLEANING AND/OR COOLING A LIQUOR GUN IN A CHEMICAL RECOVERY BOILER

CROSS RELATED APPLICATION

The application is a divisional of U.S. application Ser. No. 12/166,612 filed Jul. 2, 2008, and claims priority to application FI 20070547 filed Jul. 13, 2007, both of which applications are incorporated in their entirety by reference herein.

BACKGROUND OF INVENTION

The invention relates to a device for cleaning and cooling a liquor gun, said gun comprising at least a liquor tube for feeding liquor, such as black liquor, into a furnace of a chemical recovery boiler.

In chemical cellulose pulping roughly 35-80% of raw wood material is processed to chemical pulp, so-called "yield". In chemical pulping the yield is typically 35-55%. The rest of the wood exits the chemical pulp production unit in form of waste liquor that contains, in addition to wood-originating substances, also chemicals used in chemical pulping, which are regenerated for re-use in a so-called recovery unit of the chemical pulp mill. The most common pulp production process is the so-called kraft-process, which generates waste liquid called black liquor. The recovery unit mainly comprises the increase of dry solids in the waste liquor to 65-85%, and even higher, combustion of thus obtained strong waste liquor in the chemical recovery boiler, recovery of chemicals released and regenerated in connection with the combustion and processing of said chemicals for further chemical pulp production. In older production plants the dry-solids content of waste liquor may have remained below 65%, which complicates efficient combustion of waste liquor and chemical recovery. The sum of the mass fractions of the dry-solids content and the water in the waste liquor entering the combustion is very near to 100%.

In waste liquor combustion, the waste liquor is injected in form of droplets into a furnace, where the liquor droplets dry, pyrolyze, mix with oxygen carriers and burn. Oxygen carriers include oxygen, water vapor and carbon dioxide. Part of the droplets falls onto the bottom of the furnace, to a so-called char bed and burns there. The main part of in-organic matter exits the furnace via so-called smelt spouts located at the lower part thereof.

Feeding of waste liquor into the furnace and the injection is carried out by means of liquor guns. A liquor gun is in principle a metal tube connected to a piping, wherethrough strong black liquor is supplied from the preheaters to the boiler. The end of the liquor gun in the furnace is provided with a nozzle through which the black liquor is sprayed into the furnace and the design thereof varies depending on the size of the boiler and the manufacturer. The primary duty in the spraying is that it is carried out as symmetrically as possible and that the obtained droplet size is correct.

Liquor guns are typically pressure-dispersing; in some case steam or pressurized air-dispersing. A pressure-dispersing liquor gun typically has a tubular portion, inside which the waste liquor is taken from a liquor distribution system into the furnace, and the end of the tubular portion is provided with a nozzle. The nozzle can be just a nozzle, a nozzle provided with a deflector plate (a so-called spoon nozzle) or a centrifugal type of nozzle. The construction of the nozzle itself can be very simple: for instance, a "hole" in an end plate of said tube or said tube throttled by the deflector plate, which hole or throttling transforms the static pressure of liquor into dynamic pressure. FIG. 1 illustrates a principal view of a nozzle provided with a deflector plate, wherein the deflector plate i.e. spoon cuts a part of the nozzle opening, i.e. throttles the liquor flow. The waste liquor 1 enters the combustion in tube 2 from outside the furnace, from direction 5. The deflector plate 3 forms a throttling point 4 in the tube. The liquor exits the deflector plate 3 in form of a thin plate-like structure 6, which is finally scattered into smaller structures called droplets. Fouling material 11 falls and accumulates on the liquor gun In modern boilers, the liquor is fed into the furnace horizontally or directed slightly downwards. In a liquor gun based on a centrifugal type of nozzle at least part of the liquor jet is directed sloping more downwards than in other types of waste liquor guns.

In the furnace of a recovery boiler the inorganic matter is in melted form. This causes strong corrosion in un-cooled steel surfaces, as well as deposition and fouling on the furnace walls and also e.g. in the liquor guns. Corrosion is formed also due to accumulation and ignition of unburned waste liquor on the surface of the liquor gun, which causes high temperature and corrosive conditions. Both fouling of the liquor guns and corrosion deteriorate the liquor spraying process, which has an adverse impact in view of the operation of the furnace. The effect of fouling is prevented by means of regular cleaning of the liquor guns, so-called "scrubbing" that can be done by a person, or the cleaning can take place by means of an appropriate mechanical device. The mechanical device is typically a means moving reciprocally at regular intervals, which device has a shaft and a scraper head following the tubular portion and the nozzle part of the gun in a spring-like manner. One solution of this kind is described in U.S. Pat. No. 6,478,235.

Typically, one of the major disadvantages of liquor guns is their low resistance. Due to corrosion, the life-time and thus replacement interval is from a few days to a number of weeks. The low resistance of liquor guns is due to extremely corrosive conditions and high temperature in the furnace and its surroundings, which conditions stress the wall of the gun's metal pipe. The operation of a recovery boiler has been described e.g. in publication Vakkilainen, Esa, K. Kraft Recovery Boilers—Principles and practice. Finnish Recovery Boiler Committee r.y. 2005: The spraying and combustion of liquor is described starting from page 9-1.

Attempts have been made to prevent the above described problems relating to fouling and corrosion by means of various solutions. FI-patent application 20012500 describes a cleaning device for cleaning the liquor guns of a recovery boiler. Around the shaft of the liquor gun, one or more steam pipes are arranged, steam flowing from an end of the pipe, which is arranged closer to the liquor nozzle, around the shaft of the liquor nozzle located inside the furnace. In JP-patent application 1229890, moist steam is sprayed from outside the liquor gun to the end of the gun (the nozzle part). In JP-publication 2000256979 the zone of spraying of moist steam has been widened to relate to an opening in the furnace wall surrounding the nozzle, but still the question is about using moist steam from outside the liquor gun. A known method practiced e.g., in Japan is to lead water from the outside to the shaft of the liquor gun and thus obtain a cooling and cleaning effect.

The above described solutions have used either water or steam for cooling and cleaning the liquor gun. An essential drawback of these devices is limited cleaning and/or cooling effect obtained thereby. The effect does not extend efficiently to the whole liquor gun, especially not to its outer end on the side of the furnace. E.g. when using a deflector plate, known liquor guns are devoid of efficient cleaning and cooling of the deflector plate, which are essential factors for that kind of gun, when the aim is good controlling of the combustion in the furnace.

The drawbacks described above have been partly compensated for by increasing the amount of water or steam to the gun, but a more significant improvement is needed.

SUMMARY OF THE INVENTION

A liquor gun design has been developed having cleanability and durability better than the known designs.

A device has been developed for decreasing corrosion by cooling the outer surface of the liquor gun, and for cleaning the liquor gun. The apparatus is characterized in that it comprises an outer casing tube arranged around the liquor tube, which defines a space whereto conduits are provided for introducing water and steam and thus for generating an emulsion, or a conduit for introducing emulsion generated by water and steam to the space defined by the casing and the surface of which is provided with openings, such as pores or holes, for discharging the emulsion formed by water and steam through the outer casing.

A method has been developed that is characterized in that an outer casing tube is arranged around the liquor tube, the casing having openings on the surface, through which openings the emulsion formed by water and steam is discharged through the outer casing.

Water and steam here refer to the states of water. When generating an emulsion, additives can be used also, e.g. for better ensuring that the discharge openings of the outer casing remain open. The additive is introduced into the system e.g. together with water or via a dedicated feed pipe.

The emulsion formed by water and steam, in which emulsion the water, which is heated and evaporated for cooling the heat coming from the furnace, is used as a cooling medium. By means of a mixture of water and steam, an appropriate temperature can be maintained. Cooling medium is supplied through the outer casing only in an amount that is required for keeping the liquor gun materials at a sufficiently low temperature in view of operability and prevention of corrosion. In sooting (cleaning) stage, water/steam is introduced at an appropriate temperature required for keeping the gun clean. As the specific volume of steam is higher than that of water, the steam increases the flow velocity sufficiently in the pores or holes of the casing so that they do not get clogged but remain open. Thus, the pores and holes can be bigger and this way an adequate number of them are obtained per the square area.

The discharging of the emulsion formed by the steam and the water can take place via pores of a porous material. Alternatively, the outer casing can also be made of other suitable materials so that the openings in the outer casing are made therein. The form of the openings is for instance, round, elliptic or slot-like. The size of a round opening is e.g. 0.5-5 millimeters (mm), preferably 1-3 mm. The size of a slot-like opening is e.g. 0.2-1.5 mm×2-20 mm, preferably 0.5-1 mm×5-15 mm. When using an elliptic opening, the preferred form and size are settled within the above mentioned limits.

The device is preferably mounted such that the emulsion is discharged to the furnace side without generation of loosened deposits or emulsion jets splashing outside the furnace.

According to an embodiment of the device and method, a conduit is provided to the space defined by the outer casing for leading emulsion formed by water and steam into said space between the outer casing and the liquor tube, whereby a device for producing the emulsion is located prior to the liquor gun. The device for producing the emulsion can be common to two or more liquor guns provided with the cleaning device.

According to an embodiment of the device and method, water and steam can be supplied to the space defined by the outer casing, whereby the production of the emulsion takes place in the space defined by the outer casing. In that case, an intermediate casing tube is preferably arranged between the outer casing tube and the liquor tube, so that the water is supplied into an annular space, formed by the outer casing and the intermediate casing, i.e. an emulsion space, and the steam is supplied to an annular space formed by the intermediate casing and the liquor tube, i.e. a steam space. The surface of the intermediate casing is provided with openings such that the steam is discharged from the steam space to the emulsion space. The steam can be led into the steam space e.g. via an end of the intermediate casing tube. The steam can also be introduced via a pipe arranged in the emulsion space or in principle also via a pipe arranged inside the liquor tube.

The emulsion is arranged to flow through the openings in the outer casing substantially continuously. The flow of the emulsion can also be intermittent, for instance at 5-100 second intervals. Continuous flow is a more preferred alternative. Preferably the emulsion is arranged to flow through the openings or pores of the outer casing so that the flow is accelerated at predetermined intervals for a predefined time for intensifying the cleaning effect.

According to an embodiment of the device, a nozzle part is connected to the end of the liquor spray tube on the furnace side. The nozzle part is provided with a casing structure that is connected to the emulsion space defined by the outer casing tube. The casing structure has openings for the discharge of emulsion at least partly via the outer surface of the nozzle part.

The nozzle part can typically be a deflector plate for the liquor flow (a so-called spoon nozzle). The lower part (lower surface) of the deflector plate is provided with a plate-like piece for forming an interior between the plate-like piece and the lower part of the deflector plate. The thus formed interior (a casing of the lower part of the deflector plate) is connected to the emulsion space defined by the outer casing tube for leading the emulsion to said interior. The surface of the plate-like piece is provided with openings or it is made of a porous material for discharging emulsion out of said interior, which cleans and cools the deflector plate. The plate-like piece can have a curved form so that an end surface is formed, whereby discharge openings can be arranged in addition to the lower surface also to the end of the deflector plate structure.

According to an embodiment of the device, the end of the device at the furnace side is provided with a wall plate so that the end of the emulsion space is closed.

According to an embodiment of the device, the end of the cleaning device at the furnace side is provided with a wall plate where openings are made or pores of a porous material arranged for discharging the emulsion from the emulsion space on the end part, such as a deflector plate, of the liquor gun.

The cooling and cleaning emulsion is discharged in the direction of the radius of the liquor spray tube, i.e. in the direction of a plane located perpendicularly to the tube's longitudinal axis. The discharge openings for the emulsion can also be such that they have an inclined direction, whereby their angle of inclination in relation to the plane perpendicular to the spray tube's longitudinal axis is 0-80 degrees, preferably 30-60 degrees. Preferably the inclination of the openings is directed towards the boiler furnace, whereby the matter released from the surface of the gun as a result of the cleaning is not splattered into the boiler room surrounding the boiler.

The flow of the emulsion is accelerated at predetermined intervals for a predefined time for intensifying the cleaning effect. The flow is increased at 1-30 minute (min) intervals, preferably at 5-15 minute intervals, for intensifying the cleaning. The duration of a cleaning cycle is 1-100 seconds (s), preferably 5-20 seconds. During the cleaning of the liquor gun, the total mass flow of the emulsion is increased to 1-50 fold, preferably to 5-20 fold compared to a normal running situation. Preferably the flow of the emulsion is continuous, and it is increased as described above in accordance with the preferred embodiment. The flow of the emulsion can also be intermittent. Thereby, each cycle can also have a stage with an increased flow velocity for intensifying the effect.

SUMMARY OF THE DRAWINGS

The devices and methods disclosed herein are described in more detail in the appended Figures, of which.

DETAILED DESCRIPTION OF THE INVENTION

Figure 1:
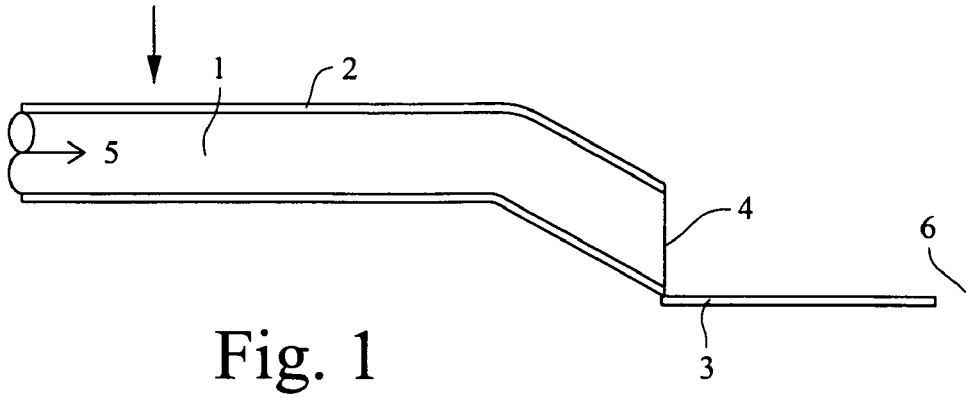
Fig. 1 Prior Art
FIG. 1 illustrates the construction and operation of a conventional liquor gun known per se and provided with a deflector plate.
Figure 2:
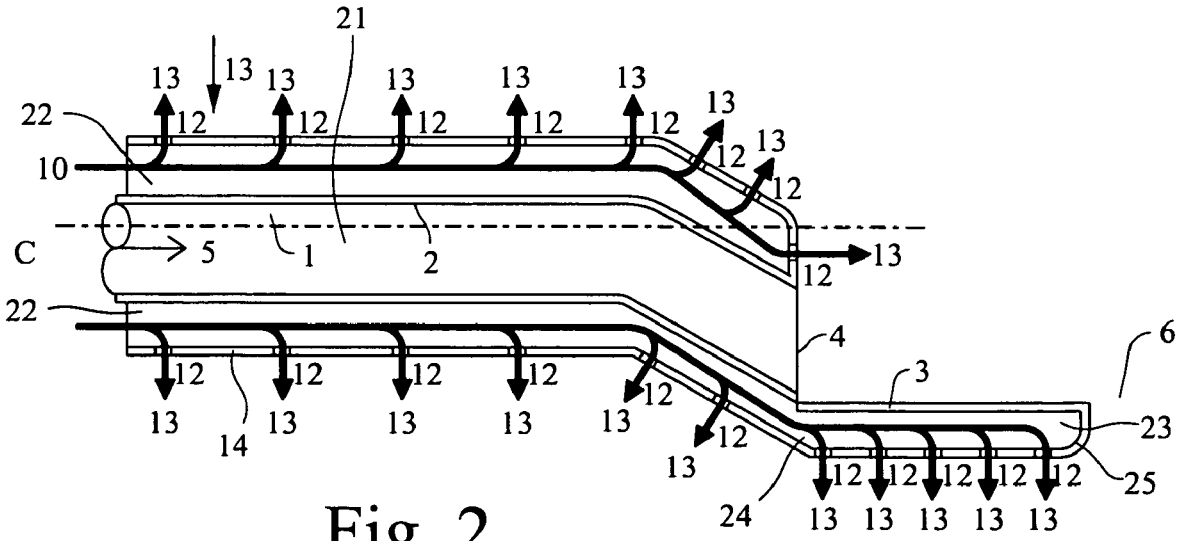
FIG. 2 illustrates schematically a liquor gun provided with a preferred embodiment of the cleaning device in side view and partly cut.

FIG. 2 illustrates a conventional liquor gun of the type illustrated in FIG. 1, to which cooling and cleaning systems have been added to the liquor gun.

An outer casing tube 14 is arranged around a liquor spray tube 2. Emulsion 10 formed by water and steam flows into the space surrounding the liquor spray tube 2, to the emulsion space 22. A device (not shown) for producing the emulsion is located prior to the liquor gun. The emulsion is discharged from the emulsion space 22 via pores or holes 12 in form of small jets 13 into the furnace. At the same time, the water in the emulsion is evaporated and binds heat, cooling the outmost surface 14 of the liquor gun. The deflector plate 3 is formed by a double plate structure, the interior 23 of which is in connection with said emulsion space 22 at point 24. Thus, emulsion flows also to the interior 23 of the deflector plate, and the lower surface 25 of the deflector plate is provided with openings 12, wherethrough emulsion is also discharged.

When the flow of the emulsion is periodically increased e.g. at 1-30 min. intervals, preferably at 5-15 min. intervals, an intensified cleaning effect is achieved; the matter 11 accumulating all around the outer surface of the gun is released and blown out of the gun and the outer surface 14 surrounding the gun.

The duration of a cleaning cycle is 1-100 s., preferably 5-20 s. A typical water flow to the emulsion is 5-100 grams/second (g/s) per liquor gun, preferably 10-30 g/s. Respectively, the steam flow is 3-100 g/s, preferably 5-30 g/s. During the cleaning the water/steam ratio of the emulsion can be changed, to achieve a higher flow velocity of the stream discharging through the pores or holes. The steam flow can be increased e.g. to an amount of 200 g/s. The above mentioned flow rates apply to a liquor gun having a waste liquor spraying capacity of 200-500 ton (t) of waste liquor dry solids/24 hours. Accordingly, in case of a smaller or greater capacity, the flows are changed to be smaller or greater in proportion to the gun capacity.

The cooling and cleaning emulsion is discharged in the direction of the radius of the liquor spray tube 2, i.e. in the direction of a plane 21 located perpendicularly to the tube's longitudinal axis C. The discharge openings for the emulsion can also be such that they have an inclined direction, whereby their angle of inclination in relation to the plane 21 perpendicular to the spray tube's longitudinal axis C is 0-80 degrees, preferably 30-60 degrees.

As mentioned earlier, the outmost surface 14 can be made of a porous material made of steel. All other alternative materials can also be applied, which are resistant to high temperature and corrosive conditions, such as alloys and ceramic materials. One possible alternative is based on the use of nickel and chromium. The outer surface can also be produced by machining small hole-like structures therein as discharge paths for the emulsion.

The porous material does not have to be homogeneous, or the machined hole-like construction need not be of equal size everywhere, or the number of the hole-like structures required is not the same for all locations. The reason for this is that the heat load or fouling is not homogenous all around.

Figure 3:
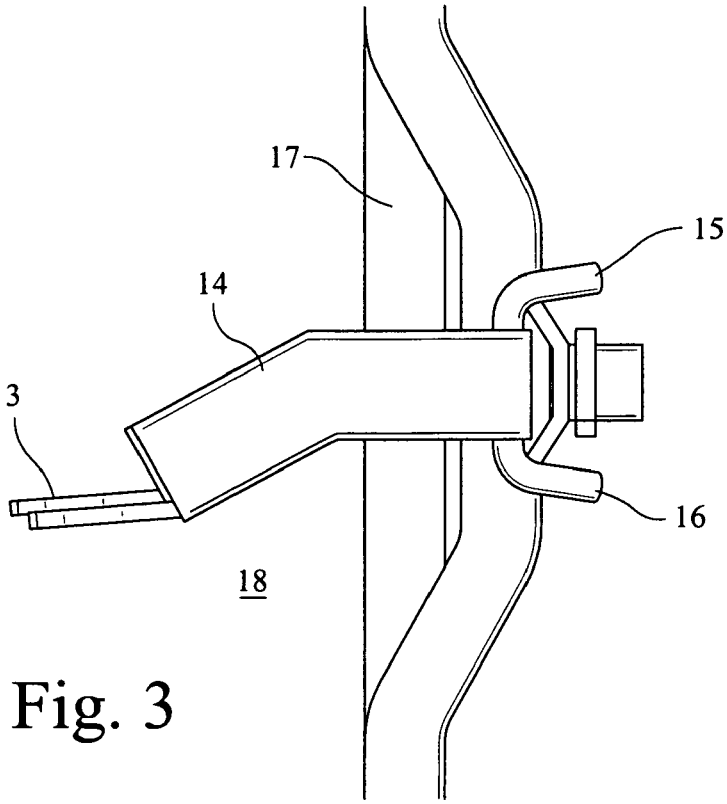
FIG. 3 is a side view of a liquor gun provided with a cleaning device.

A preferred solution is to form the emulsion prior to the liquor gun, but the emulsion can be mixed from steam and water only in the liquor gun. Then both water and steam are introduced to the gun with separate pipes. FIG. 3 illustrates a liquor gun provided with a cleaning device. The liquor gun with its outer casing 14 extends via an opening in the tube wall 17 of the boiler furnace into the furnace 18. Water is introduced into the cleaning device via conduit 15 and steam via conduit 16. Typically in that case the liquor spray tube is surrounded by two casings within each other, an intermediate casing and an outer casing. The steam space is formed against the waste liquor space, i.e. the annular space between the intermediate casing and the spray tube. The space formed between the outer casing and the intermediate casing is reserved for water. However, in this solution the steam is not discharged directly into the furnace, but into the water space, wherein it forms with the water an emulsion, and the emulsion is discharged into the furnace, cooling and cleaning the liquor gun.

Figure 4:
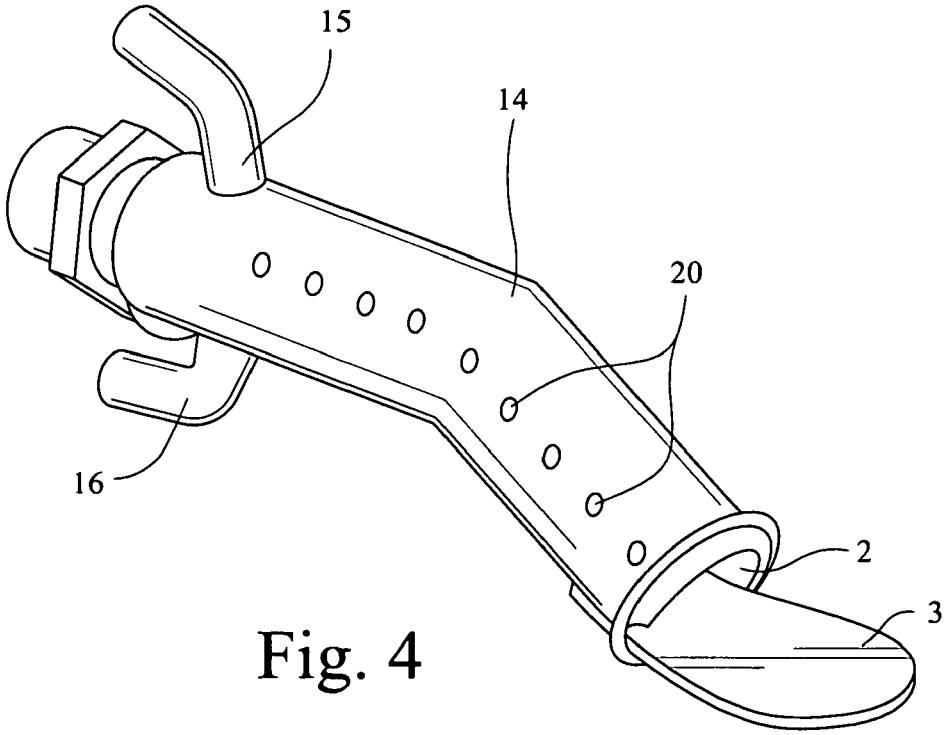
FIG. 4 illustrates schematically a liquor gun provided with a preferred embodiment of the cleaning device in cutaway view.

FIG. 4 illustrates a liquor gun provided with a cleaning device so that the outer casing 14 is not shown in the figure, but the intermediate casing 19 surrounding the liquor tube 2. Water is introduced into the space between the intermediate casing and the outer casing from conduit 15. The steam is introduced into the space between the intermediate casing and the liquor tube 2 via conduit 16. The intermediate casing is in the emulsion formation zone provided with holes 20 of adequate size from the steam space to the water/emulsion space, whereby the steam is discharged via these holes into the water space and emulsion is formed in the zone. The emulsion is further discharged from this outer space, via the porous material, or openings in the perforated material, as previously described in FIG. 2.

Figure 5:
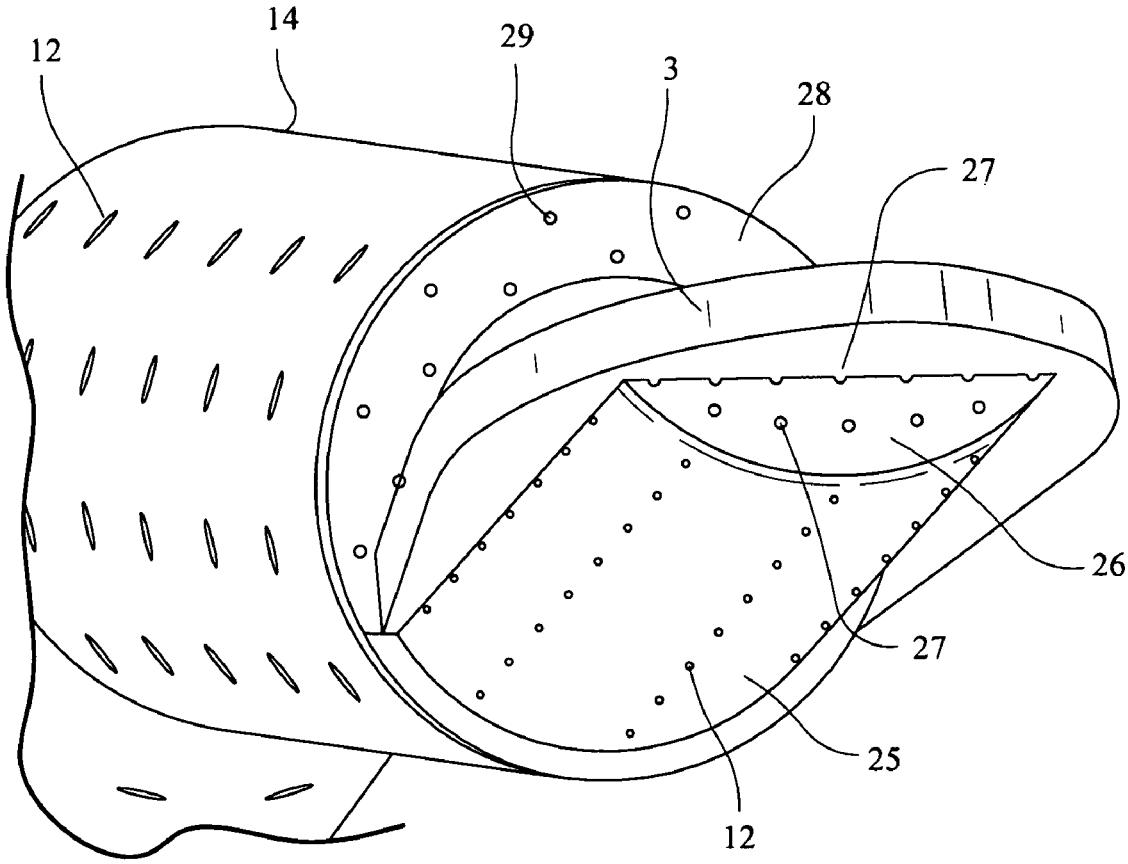
FIG. 5 illustrates schematically an embodiment of a nozzle part of a liquor gun provided with a cleaning device.

FIG. 5 illustrates a nozzle part of a liquor gun provided with a cleaning device. The outer casing tube 14 mounted around the liquor spray tube is provided with openings 12 as described in connection FIG. 2. The nozzle part is formed by a deflector plate 3. The lower part of the deflector plate is provided with a plate-like piece 25 for forming an interior between the plate-like piece and the lower part of the deflector plate, as described in connection FIG. 2. The thus formed interior is connected to the emulsion space defined by the outer casing tube for leading the emulsion to said interior. The surface of the plate-like piece is provided with openings or it is made of a porous material for discharging emulsion out of said interior, which cleans and cools the deflector plate. The plate-like piece 25 has a curved form so that an end surface 26 is formed, whereby discharge openings 27 can be arranged in addition to the lower surface also to the end of the deflector plate structure.

According to the embodiment of the FIG. 5 the end of the cleaning device at the furnace side is provided with a wall plate 28 where openings 29 are made for discharging the emulsion from the emulsion space on the end part, such as the deflector plate 3, of the liquor gun. According to another embodiment, the end of the device at the furnace side is provided with a wall plate 28 devoid of openings so that the end of the emulsion space is closed.

In a centrifugal dispersion nozzle, the cooling and cleaning arrangement surrounds also the centrifugal part.

The system described in the above comprises the necessary constructions and arrangements related to security. This means that the mixture ratio of the emulsion being formed remains within the targeted limits, the water flow amount for each liquor gun does not grow too high in view of security, and the steam flow amount for each liquor gun does not grow too high. Naturally, the pressure and temperature of the steam is to remain within the determined limits and the gun with its mountings is to operate in the designed way. The liquor gun is provided with a system so that it can be moved and operated manually or from an operator room.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

We claim:

1. A liquor gun comprising:

a liquor tube to feed liquor to a chemical recovery boiler furnace;

an outer casing tube arranged around the liquor tube, and a space within said outer casing tube through which flows an emulsion formed by water and steam, wherein the outer casing tube has openings for discharging the emulsion to an outer surface of the outer casing tube.

2. The liquor gun according to claim 1 wherein the openings are at least one of pores and holes in the outer casing tube.

3. The liquor gun according to claim 1, wherein the outer casing if formed of a porous material and the pores in the porous material form the openings.

4. The liquor gun according to claim 1, wherein the openings in the outer casing are machined openings.

5. The liquor gun according to claim 4, wherein each of the openings is one of a round, an elliptic and a slot opening.

6. The liquor gun according to claim 5, wherein the openings are round openings each having a diameter of between 0.5 millimeter (mm) to 5 mm.

7. The liquor gun according to claim 5, wherein the openings are slot-like openings each having a length between 0.2 to 1.5 mm and a width between 2 to 20 mm.

8. The liquor gun according to claim 1, further including a conduit leading to the outer casing tube for introducing emulsion formed by water and steam into the space within the casing, whereby an emulsion generation device producing the emulsion is located prior to the liquor gun.

9. The liquor gun according to claim 8, wherein the device for producing the emulsion is common to two or more liquor guns.

10. The liquor gun according to claim 1, further including conduits connected to the outer casing tube for leading water and steam thereto, whereby the production of the emulsion takes place in by the outer casing.

11. The liquor gun according to claim 10, further including an intermediate casing tube between the outer casing and the liquor tube so that the water is lead into an annular space formed by the outer casing, and a surface of the intermediate casing is provided with openings so that the steam is discharged into the annular space for generation of the emulsion from the water and the steam.

12. The liquor gun according to claim 1, wherein the emulsion is arranged to flow through the openings in the outer casing essentially continuously at a predefined flow velocity.

13. The liquor gun according to claim 1, wherein the emulsion flows intermittently through the openings in the outer casing.

14. The liquor gun according to claim 1, wherein the emulsion flows through the openings in the outer casing so that the flow is accelerated at predetermined intervals for a predefined time.

15. The liquor gun according to claim 1, wherein a nozzle part is connected to the end of the liquor spray tube on a side of the furnace, said nozzle part being provided with a casing structure connected to the space within the outer casing tube and provided with openings for discharging the emulsion at least partly through the outer surface of the nozzle part.

16. The liquor gun according to claim 15, wherein a liquor flow deflector plate is connected to the end of the liquor spray tube on the furnace side, a lower side of which deflector plate is provided with a plate-like piece for forming an interior that is connected to the space defined by the outer casing for leading emulsion into said interior, and the surface of the plate-like piece is provided with openings for discharging the emulsion from the interior.

17. The liquor gun according to claim 1, wherein an end of the device at the furnace is provided with an end plate so that the end is closed.

18. The liquor gun according to claim 1, wherein an end of the device at the furnace is provided with an end plate having openings for discharging the emulsion from the space onto an end part of the liquor gun.

19. The liquor gun according to claim 1, wherein the liquor tube has a longitudinal axis, and the openings in the outer casing are directed such that the emulsion is discharged in the direction of a plane perpendicular to the axis.

20. The liquor gun according to claim 1, wherein the liquor spray tube has a longitudinal axis, and the openings in the outer casing are inclined such that the emulsion is discharged in relation to a plan perpendicular to an axis of the liquor tube in an angle of 0 to 80 degrees.

* * * * *